United States Patent [19]

Douillard

[11] 4,403,451

[45] Sep. 13, 1983

[54] WEATHERSTRIPPING METHOD AND ARRANGEMENT

[76] Inventor: Roger R. Douillard, 66 Columbus Ave., Valhalla, N.Y. 10595

[21] Appl. No.: 323,561

[22] Filed: Nov. 20, 1981

[51] Int. Cl.[3] ..... E06B 7/16

[52] U.S. Cl. ..... 49/475; 49/485

[58] Field of Search ..... 49/475, 485; 156/71, 156/247, 289, 295

[56] References Cited

U.S. PATENT DOCUMENTS 4,233,780 11/1980 Royce et al. ..... 49/475 X

FOREIGN PATENT DOCUMENTS 2361444 6/1975 Fed. Rep. of Germany ..... 49/485
2294318 7/1976 France ..... 49/475
2029479 3/1980 United Kingdom ..... 49/475

*Primary Examiner*—Kenneth Downey

*Attorney, Agent, or Firm*—Spellman & Joel

[57] ABSTRACT

This invention relates to a weatherstripping method and arrangement primarily for doors which is designed to eliminate drafts which result in heating and cooling losses. The arrangement is simple to install and relatively inexpensive. An elongated wood lattice strip is mounted to the door jamb on both sides of the door and along the top and spaced at a predetermined distance from the door when the door is in a closed position. A lubricant is applied along the exterior face and top of the door opposite the wood lattice and a paper tape is placed over the lubricated area. The door is then closed and a silicone rubber caulking compound is inserted into the space between the paper tape and the lattice strip. The door is maintained in a closed position until the silicone caulking hardens and then the door is opened and the paper tape peeled away from the lubricated surface. The silicone bead thus provides a formfitting weatherstripping door.

10 Claims, 2 Drawing Figures

WEATHERSTRIPPING METHOD AND ARRANGEMENT

BACKGROUND OF THE INVENTION

The present invention relates to a weatherstripping method and arrangement for doors and particularly to a new and improved formfitting weatherstripping arrangement.

With the current emphasis on fuel savings, in both summer and winter, it is important to have tight fitting doors. A secure structure would save air conditioning in the summer and heat in the winter. Conventional weatherstripping arrangements involve for example, felt strips mounted along the door edges or interlocking strips of metal along the edges of the door. The felt strips fail to stand up under the rigors of repeated door openings and closing and the interlocking metal edges are costly to install since they require installation by a specialist. Furthermore, the interlocking edges often become bent and it is then difficult to close the door.

In contrast to the conventional weatherstripping arrangements, the present invention proposes a simple and economical weatherstripping arrangement which can be readily installed by anyone. The only effort involved is nailing a wood lattice strip to the door jambs at a set distance therefrom, and taping the door surfaces opposite the lattice strips and then caulking the space between the jamb and strip with a conventional caulking gun. When the caulking compound, usually a silicone, rubber hardens and adhers to the lattice strip, the result is a tight formfitting door.

SUMMARY OF THE INVENTION

This invention comprises a weatherstripping arrangement for doors and a method for weatherstripping said doors.

The invention comprises wood lattice strips which are mounted to the door jambs on both sides and along the top of a door and at a spaced distance from said door. A lubricant is applied to the exterior face of the door opposite the lattice strips and a paper tape is placed over the lubricant. The door is then closed and a silicone caulking compound is forced into the space between the lattice strip and the taped portion of the door. The compound also flows into any space between the door jamb and the exterior face of the door. When the silicone compound hardens after a predetermined time period the door is opened and the paper strip is then peeled from the lubricated portion of the door. The result is a formfitting weatherstripped door.

Accordingly, it is an object of this invention to provide a new and improved weatherstripping arrangement for doors.

Another object of this invention is to provide a formfitting weatherstripping for doors which is simple and economical to install.

A more specific object of this invention is to provide a new and improved weatherstripping method and arrangement wherein a silicone bead is applied between a lattice strip and the exterior face of the door along both sides and the top of said door and aheres to the lattice strip forming a tight seal.

BRIEF DESCRIPTION OF THE DRAWINGS

Other objects and advantages of the present invention would be more clearly seen when viewed in conjunction with the accompanying drawings wherein.

DETAILED DESCRIPTION OF THE INVENTION

Figure 1:
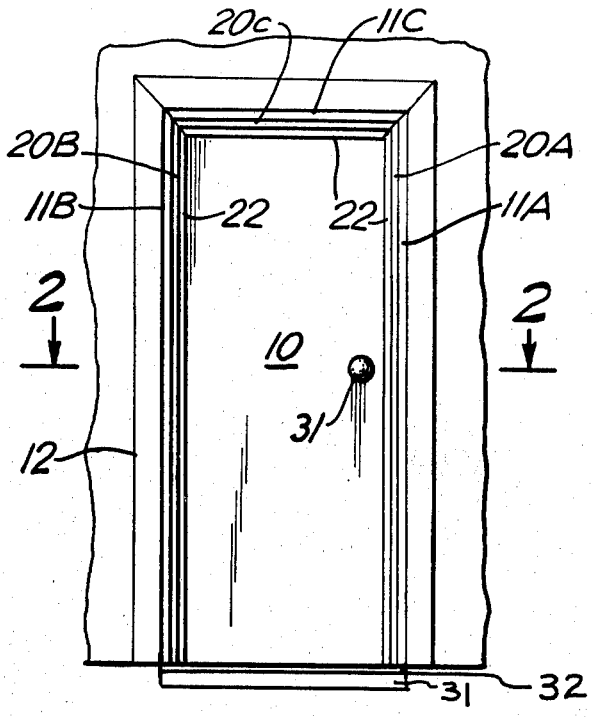
FIG. 1 is a front view of the invention.
Figure 2:
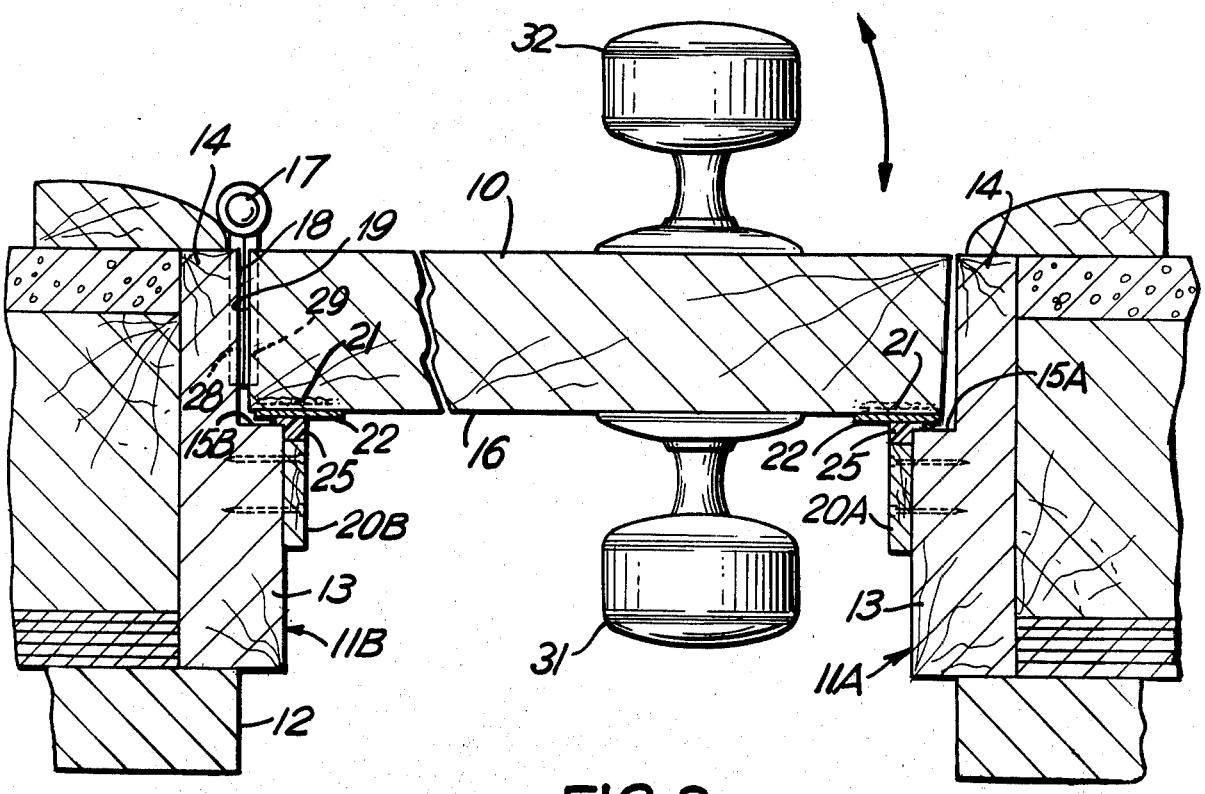
FIG. 2 is a cross-sectional view of the invention taken along the line 2—2 of FIG. 1.

Referring now to the drawings, the invention comprises a weatherstripping method and arrangement primarily for doors 10. The invention is designed to minimize heating and cooling losses which must be prevented in view of the high cost of fuel. In a typical door installation, door jambs 11A and 11B are mounted to the walls 12 of the building structure on both sides of the door 10. A similar jamb 11C is mounted to the upper portion of the wall 12. Each jamb 11A, 11B and 11C comprises, as shown in FIG. 2; an enlarged portion 13 and a narrow portion 14 which forms a cutout to accommodate the door 10. The surfaces 15A and 15B comprise a door stop which engages the outer surface 16 of the door 10.

A hinge 17 is mounted to the surface 18 of jamb 11B and to the surface 19 of the door 10 by mounting plates 28 and 29 respectively. The door thus pivots in the direction of the arrows about the hinge 17 when a force is applied to either the outside door knob 31 or the inside door knob 32.

In the invention, a wood lattice strip 20A, 20B and 20C, approximately 1⅛ inch wide, is mounted to the door jambs 11A, 11B and 11C at a distance of approximately 3/16 inches from the door 10 in a closed position. The lattice strips 20A, 20B and 20C are approximately 3/16 inches thick.

The space between the wood lattice strips 20A, 20B and 20C and the door 10 is filled with a silicone caulking compound 25 when the door is in a closed position. To prevent the silicone caulking compound 25 from adhering to the door 10, a lubricant 21 such as vegetable shortening is applied along the periphery of the outer door surface 16 on both sides and along the top thereof. The lubricant is applied approximately 1 inch in from the door edge on top and 1 inch in from the door edge on the two sides. A paper tape 22 approximately 1 inch wide is applied over the lubricated area which is approximately 1 inch wide, along the top edge and two sides of the door 10. The tape 22 is pressed firmly until it sticks to the door 10. The excess lubricant seepage is wiped from the surface of the door 10.

With the door closed as previously noted, a silicone compound 25 such as GE silicone rubber caulking in a clear white or other available colors is applied from a standard refillable cartridge with a caulking gun. Starting at the top edge of the door the caulking compound 25 is inserted into the space between the paper tape 22 and the lattice strips 20A and 20C. The caulking compound 25 also flows between the door jambs 11A, 11B and 11C and the taped lubricated surface to completely fill the space. The bead of caulking 25 is kept as flat as possible to the lattice strips 11A, 11B and 11C with trowling if necessary.

After caulking the door is maintained in a closed position to permit the silicone compound 25 to set up and harden. Preferably, the door should be kept closed for 24 hours but it can be opened if necessary, in approximately 1½ hours. After the compound 25 has hardened, the door is opened and the paper tape 22 is peeled from the silicone compound 25. The lattice strips 20A, 20B and 20C remain in place with the compound 25 adhering thereto to provide a formfitting weatherstripping arrangement. The arrangement is simple to install and relatively inexpensive.

As a further improvement, the base 31 of the door 10 may be weatherstripped using the teachings of the present invention. In such case, a wood saddle 32 comprising a substantially rectangular cross-section would be mounted on the saddle 31. The door would then be removed and beveled at an angle of approximately 15° to match the bevel on the saddle member 32 but with a slight clearance therebetween. A strip of paper tape similar to that used on the sides is placed on the saddle 32 opposite the base 31 of the door 10. The door 10 is then removed from its hinges and a bead of silicone caulking compound 25 is placed along the bottom. The door 10 is promptly placed back on the hinges 17 and gently moved to the closed position and let sit for a predetermined time interval. Finally, the door is opened and the tape is removed from the beveled member 32 which may be lubricated to facilitate removal of the tape. The door 10 now has a formfitting seal along the base 31 thereof.

If is understood that the above-described arrangements are merely illustrative examples of the application. Numerous other arrangements may be readily devised by those skilled in the art which will embody the principles of the invention and fail within the spirit and scope thereof.

What is claimed is:

1. A weatherstripping arrangement for a door which is hinged to a door jamb on one side and closes against a door jamb on the other side comprising:

a separate elongated wooden lattice strip mounted to the door jamb on each side of the door at a predetermined distance from the door when the door is in a closed position and a separate lattice strip mounted to the upper jamb at a spaced distance from the top of the door, a lubricant applied to said door along the periphery of the closing face of said door on both sides and along the top thereof, a tape strip positioned over said lubricant and removable therefrom, and, a silicone compound inserted between the tape strip and the edge of the wooden lattice strip with the door in a closed position, said compound flowing into the space between the jamb and door surface and wherein said silicone compound is allowed to harden in place to the lattice strip and door jamb to form a formfitting closure with the door.

2. A method of weatherstripping a door mounted to conventional door jambs comprising:

mounting an elongated wooden lattice strip along the door jambs on both sides thereof and along the upper jamb at a spaced distance from the door and therefrom applying a lubricant along the periphery of the outer door surface opposite the door jambs and lattice strips, mounting a paper tape over the lubricant, applying a silicone compound in the space between the wooden lattice strip and the paper tape and forcing said compound into the space between the door jamb and taped outer surface with the door in a closed position, allowing said silicone compound to harden for a predetermined time to form a formfitting closure, and, removing the tape from the lubricant.

3. A weatherstripping arrangement in accordance with claim 1 wherein:

the wooden lattice strip is spaced approximately 3/16 inches from the door when the door is in a closed position.

4. A weatherstripping arrangement in accordance with claim 3 wherein:

the wooden lattice strip is approximately 1⅛ inches wide and 3/16 inches thick.

5. A weatherstripping arrangement in accordance with claim 1 wherein:

the lubricant is vegetable shortening.

6. A weatherstripping arrangement in accordance with claim 1 wherein:

the silicone compound is a silicone rubber caulking compound.

7. The method of weatherstripping a door in accordance with claim 2 wherein:

the silicone compound is allowed to harden for approximately 24 hours.

8. The method of weatherstripping a door in accordance with claim 2 wherein:

the lattice strips are mounted to the door jambs approximately 3/16 inches from the door when closed.

9. A weatherstripping arrangement for a door in accordance with claim 1 further including;

a saddle member having a beveled upper surface mounted opposite the base of the door and wherein the base of the door is beveled to match the surface of the saddle member but with a clearance therebetween, a removable paper strip mounted on the saddle member opposite the base of the door and a silicone caulking compound applied into the clearance between the door and the saddle member, said silicone caulking compound adhering to the door to form a seal along the base thereof.

10. A method of weatherstripping a door in accordance with claim 2 further including;

mounting a saddle member having a beveled upper surface opposite the base of the door in a closed position;

beveling the door to match the bevel on the bevel on the saddle member at a spaced distance therefrom, applying a lubricant to the beveled surface and a paper tape thereover, inserting a silicone compound into the clearance between the door base and the paper tape, and allowing the silicone compound to set for a predetermined time interval and then removing the paper tape from the saddle member.

* * * * *